United States Patent [19]

Kjelgaard

[11] Patent Number: 4,884,695

[45] Date of Patent: Dec. 5, 1989

[54] PACKING CONTAINER

[75] Inventor: Tom Kjelgaard, Löddeköpinge, Sweden

[73] Assignee: Roby Teknik Aktiebolag, Lund, Sweden

[21] Appl. No.: 286,876

[22] Filed: Dec. 20, 1988

[30] Foreign Application Priority Data

Dec. 23, 1987 [SE] Sweden ..... 8705153

[51] Int. Cl.[4] ..... B65D 5/70; B65D 5/74

[52] U.S. Cl. ..... 206/631.2; 206/617; 229/123.1

[58] Field of Search ..... 229/123.1, 123.2; 206/631, 631.2, 617, 618, 631.3, 632

[56] References Cited

U.S. PATENT DOCUMENTS

| | | | |
|---|---|---|---|
| 3,827,625 | 8/1974 | Miller | 206/631 |
| 4,433,784 | 2/1984 | Kjelgaard | 206/631.2 |
| 4,488,647 | 12/1984 | Davis | 206/631 |
| 4,762,234 | 8/1988 | Wyberg | 206/631.2 |
| 4,787,507 | 11/1988 | Rausing | 206/617 |
| 4,792,048 | 12/1988 | Wyberg | 206/631.3 |

FOREIGN PATENT DOCUMENTS

| | | | |
|---|---|---|---|
| 2801404 | 7/1979 | Fed. Rep. of Germany | 206/617 |

*Primary Examiner*—Gary Elkins

*Attorney, Agent, or Firm*—Burns, Doane, Swecker & Mathis

[57] ABSTRACT

Packing containers manufactured from plastic-coated paper and having a sealing fin wherein the packing material is joined inside-to-inside in a sealed union, the material layers so joined together accommodating between them, at least along a part of the sealing fin, a tearing strip inserted in the sealing fin which is sealed to the inner plastic coating of the packing material. To facilitate the pulling off of the tearing strip on opening of the container, the packing material is provided at least within the region of the part of the sealing fin accommodating the strip with a material layer adapted to weaken adherence which is applied between the fibrous layer and the inner plastic coating of the packing material and preferably consists of water glass.

14 Claims, 1 Drawing Sheet

PACKING CONTAINER

BACKGROUND OF THE INVENTION

The present invention relates to a packing container of the type which is manufactured from a plastic-coated fibrous material and which has a sealing fin extending across the upper end wall of the container. The packing material is joined inside to inside in a sealed union and the packing material layers are so joined that, at least along a part of the sealing fin, a tearing strip is disposed in the sealing fin which comprises a pull-lug accessible from outside the container. The tearing strip is sealed to the inner plastic coating of the packing material.

The usual form of packing container for distribution of milk, fruit juice and other liquid foodstuffs is manufactured from a web of paper or cardboard, plastic-coated on both sides, this web being formed to a tube in that the longitudinal edges of the web are joined together in an overlap joint, whereafter the tube formed is filled with the intended contents and sealed transversely by means of repeated flattening and transverse sealing operations along zones located at right angles to the longitudinal direction of the tube at a distance from one another. The sealed-off portions of the tube can be separated subsequently by means of transverse cuts in the said sealing zones, whereafter a parallelepipedic shape can be imparted to the packing units formed, most frequently through pressure-forming and folding of the packing material along crease-lines provided beforehand. In the course of the folding and forming work, double-walled, triangular lugs are formed at four corners of the packing container which can be doubled against, and sealed to, the side or end walls respectively of the packing container.

A packing container of the type referred to here will have a longitudinal overlap joint, namely the joint which constitutes the longitudinal joint of tube, and the upper and lower end walls of the container will have transverse, finlike sealing joints in which the packing material is joined inside to inside. The transverse and longitudinal sealing joints cross each other at the upper and lower end surface of the packing container.

Generally, in packing containers of the type mentioned here, one of the triangular corner lugs is used as an emptying opening which is opened by putting up the triangular lug from its doubled position against the packing container, and by tearing or cutting off the sealing fin so that a connecting duct to the interior of the container is achieved.

Since certain inconveniences may be experienced in the tearing of the triangular corner lug along a prepared perforation line, and as a cutting off of the sealing fin presupposes the use of a tool, it has been proposed instead to solve the problem in such a manner that a tearing strip is inserted in the sealing fin from the tip of the triangular corner lug serving as a pouring opening up to, and past, the point of crossing between longitudinal and transverse joint, so that the tearing strip is accessible from the outside of the container. With the help of such a tearing strip the sealing joint in the sealing fin can thus be broken or cut up, so that a pouring opening is achieved.

This form of package opening with the help of a tearing strip, where the tearing strip is intended to tear through the seal produced in order to form an emptying opening, has been found, however, not to function to complete satisfaction. In the first place, the tearing strip often fails to cut directly into the sealing joint but instead cuts between the paper material and the plastic coating on either of the material layers. This exposes the raw fibre surface of the paper layer of the packing material so that the contents, on being poured out through the emptying openings, come into contact with the absorbent, exposed fibre surface which rapidly swells up and loses its rigidity. Other inconveniences are that, among other things, relatively great forces are needed for tearing up the sealing joint, and it happens not infrequently that the tearing strip rips asunder the paper layer on one side of the sealing fin, i.e., the tearing strip.

SUMMARY OF THE INVENTION

In accordance with the present invention, it has been found, however, that the inconveniences which arise in connection with known packing containers provided with tearing strips can be almost completely eliminated if the adhesive power between the fibrous layer of the packing material and the inner plastic coating is weakened, at least within the region of the part of the sealing fin accomodating the strip, so that it is less than the adhesive power between the inserted tearing strip and the packing material. On tearing the tearing strip, consequently, the parts of the inner plastic coating of the packing material which are sealed with good adherence to the tearing strip will relatively easily let go of the fibrous layer and accompany the tearing strip, as it is withdrawn, without roughening or exposing any absorbent raw paper fibres in the torn region of the sealing fin.

In accordance with the invention the weakening of adherence is realized in that the packing material, at least within the region of the sealing fin accomodating the strip, is provided with a layer of material adapted to weaken adherence. The materials is located between the fibrous layer and the inner plastic coating of the packing material, and is applied directly to the fibrous layer before the same is coated with plastics. This layer may consist of any material among the range of known materials with the capacity of reducing the adhesive power between plastic and fibrous layers, e.g. surlyn-dispersion (Du Pont 56220), sodium carboxymethyl cellulose (Blanose 7LFD, Hercules) etc., but among the materials known at present, water glass (sodium silicate) is preferred as this has been found to function particularly well and advantageously. Apart from water glass being physiologically compatible, inexpensive and easy to apply, it also has the advantage that, at least partly, it penetrates and impregnates the fibrous layer and thus imparts an effective moisture barrier on the uncovered fibrous layer after withdrawal of the tearing strip. Practical experiments have shown that a water glass layer in an amount of approx. 4–5 g dry weight/$m^2$ functions well.

The requirement made on a tearing strip functioning well is, of course, that it should be made of a material of sufficiently high tensile strength so that it does not break on opening of the container. In acordance with the invention, the tearing strip, therefore, consists preferably of a plastic material of relatively small extensibility, e.g. polyester. Polyester material or other plastic material of comparable strength characteristics and extension characteristics, as a rule, has a melting range which lies higher than the melting range for polythene, which is the most commonly used coating material on a packing material. Consequently it is therefore difficult to heat-seal a tearing strip of polyester directly to a polythene layer. To facilitate the heat-sealing of the tearing strip to the plastic coating of the packing material it is appropriate, therefore, to provide the polyester strip with more readily melting outer sealing coatings of polythene.

To facilitate withdrawal of the tearing strip on opening of the container it may be suitable, moreover, to provide the part of the tearing strip accessible from the outside of the container with a loop or grip-ring.

BRIEF DESCRIPTION OF THE DRAWINGS

The invention will now be described in greater detail with special reference to the attached drawings, wherein.

DETAILED DESCRIPTION

Figure 1:
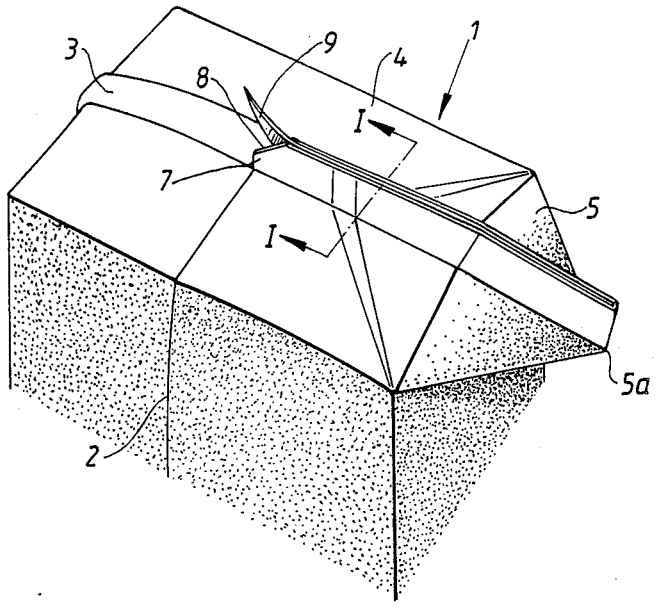
FIG. 1 shows the top part of a packing container in accordance with the invention not yet opened.
Figure 2:
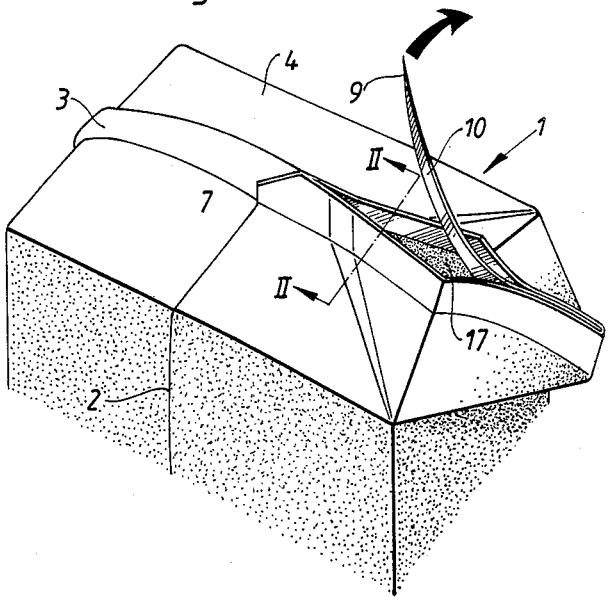
FIG. 2 shows the packing container during tearing.

The packing container 1 shown in FIGS. 1 and 2 is of the type which has been described previously. That is, the packing container manufactured from a web folded up to a tube which thereafter is filled with contents and transversely sealed.

The packing container 1 has a longitudinal sealing joint 2 of the overlap type and a sealing fin 3 which extends along the upper end wall 4 of the packing container 1. As is evident, the packing container has a triangular, double-walled lug 5, which is intended to function as an emptying opening. In FIG. 1, the triangular lug 5 has been detached and partially raised up from the side wall 6 of the packing container against which it is normally sealed.

In the crossing point 7 between the longitudinal overlap joint 2 and the transverse sealing fin 3, the edge of the overlapping material has been cut obliquely along the region 8. In the crossing point 7 projects a part 9 of a strip 10 inserted into the fin 3. The strip part 9 thus projecting appropriately may be in the form of, or be provided with, a grip-ring or loop by means of which the withdrawal of the strip 10 can be facilitated.

Figure 3:
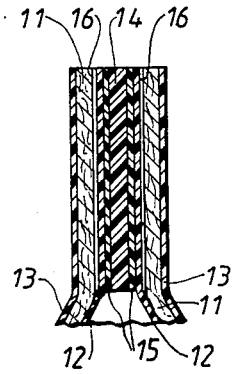
FIGS. 3 and 4 show cross-sections of the packing container in accordance with FIGS. 1 and 2 along the section lines I—I and II—II respectively.
Figure 4:
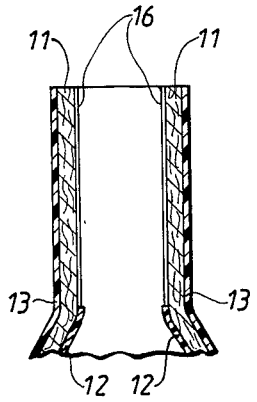

As is evident from FIG. 3 and partly also from FIG. 4, which show strongly enlarged cross-sections of the packing container 1 along the lines I—I and II—II, respectively, the packing container 1 is manufactured from a packing laminate consisting of a central carrier layer 11 of paper or cardboard imparting stiffness, and of thin layers 12 and 13 of liquid-tight plastic material, preferably polythene laminated to both sides of the carrier layer. The material layers of the sealing fin 3 facing one another accomodate between them the strip 10. The strip 10 is inserted in the sealing fin along a region which extends from the tip 5*a* of the double-walled triangular lug 5 to the crossing point 7 between the longitudinal joint 2 and the sealing fin 3. The strip 10 is accessible from the outside by means of the projecting free strip portion 9 which preferably is in the form of a loop.

In the example shown here, the strip 10 consists of a laminated material including a central layer 14 of a plastic material strong in tension, preferably polyester, and outer coatings 15 of sealable plastic material, preferably polythene. Moreover, the strip 10 thus inserted is sealed with good adhesive power to the surrounding material layers of the sealing fin 3 through surface fusion between the outer plastic coatings 15 of the strip and the oppositely situated inner plastic coatings 12 of the material layer.

To make possible an easy tearing away of the tearing strip 10, the packing material comprises within a region corresponding at least to the region of the sealing fin 3 accomodating the strip, a thin layer 16 of a material adapted to weaken adherence. Preferably, this material is water glass, and is applied between the carrier layer 11 and the inner plastic coating 12 of the packing material. The application of the thin material layer 16 causes the adherence between the carrier layer 11 and the inner plastic coating of the packing material to be within the region accomodating the strip than within the remaining region of the packing material.

The opening of packing container 1 is done in a manner which is evident from FIGS. 1 and 2. First, the double-walled triangular lug 5 sealed against the side wall 6 is raised so that it lies essentially in the same plane as the upper end surface 4 of the packing container, as shown in FIG. 1. Thereafter the end 9, freely projecting at the crossing point 7, is seized, and the strip 10 is pulled upwards and backwards, towards the right in FIG. 2. As a result, the strip 10 is withdrawn along with the plastic coating 12 which, in turn is, sealed with good adherence to the outer coatings 15 of the strip The plastic coating 12 readily withdraws from the carrier layer 11 of the packing material along the region of the sealing fin with weakened adherence, to uncover an emptying opening 17.

Practical experiments have shown that a packing container 1 in accordance with the invention is very easy to open in the manner described above with the help of the inserted tearing strip 10, without excessive expenditure of force and without any risk of delamination or going astray of the tearing strip. Furthermore, it has been found that the inner plastic coating 12 of the packing material very readily lets go of the carrier layer 11 within the region adapted to weaken adherence without roughening or exposing any absorbent raw paper or cardboard fibres in the region opened. In particular it has been found that a material layer 16 which consists of water glass is particularly effective, since water glass, at least partially, penetrates into, and impregnates, the carrier layer 11 thus imparting a moisture-protecting impregnating outer layer to the carrier layer 11 which contributes to reducing the risk of roughening and exposing absorbent fibres in the emptying opening.

What is claimed is:

1. A packing container manufactured from a fibrous packing material coated with plastic on an inside surface and having a sealing fin, extending across an upper end wall of the container, said packing material joined inside to inside in a sealed union to form packing material layers, said packing material layers accomodating between them, along at least a part of the sealing fin, a tearing strip, said tearing strip being disposed in the sealing fin, said tearing strip comprising a pull-lug accessible from outside the container, said tearing strip being sealed to an inner plastic coating of the packing material, said packing material, at least within a region of the sealing fin accommodating the strip, having a material layer adapted to weaken adherence between a fibrous layer and an inner plastic coating of the packing material, the adherence between the fibrous layer and the inner plastic coating of the packing material being less than the adherence between the tearing strip and the inner plastic coating within said region of weakened adherence of the sealing fin.

2. A packing container in accordance with claim 1, wherein the tearing strip further comprises a central layer of a material strong in tension and outer coatings of sealable plastics such that a seal between the tearing strip and the packing material is formed through surface fusion between said plastic coatings of the tearing strip and the inner plastic coating of the packing material.

3. A packing container in accordance with claim 2, wherein said central layer of the material strong in tension is comprised of polyester.

4. A packing container in accordance with claim 1, wherein said projecting pull-lug of the tearing strip is a grip-ring or loop.

5. A packing container in accordance claim 1, wherein said material layer adapted to weaken adherence consists of a thin coating of water glass applied directly to the fibrous layer of the packing material.

6. A packing container in accordance with claim 5, wherein the water glass coating amounts to 4–5 g dry weight/$m^2$.

7. A packing container formed of packing material having inside surfaces with plastic coating comprising, packing material joints formed from the sealed union of inside surfaces of said packing material, a sealing fin formed of said packing material joints and extending across an upper end wall of said container, a tearing strip disposed within said packing material joint along a segment of said sealing fin, said tearing strip sealed to said plastic coating of said packing material, a material layer disposed upon said packing material beneath said plastic coating along said segment of said sealing fin, such that the adhesion between the packing material and the plastic coating is less than the adhesion between the tearing strip and the plastic coating.

8. A packing container in accordance with claim 7, wherein the tearing strip includes a central layer coated with a sealable plastic that provides a surface fusion with said plastic coating of said packing material.

9. A packing container in accordance with claim 7 wherein said tearing strip includes a pulling means for tearing said strip from said packing material.

10. A packing container in accordance with claim 9 wherein said pulling means is a grip-ring.

11. A packing container in accordance with claim 9 wherein said pulling means is a loop.

12. A packing container in accordance with claim 7, wherein said material layer is made of water glass.

13. A packing container in accordance with claim 12, wherein said water glass amounts to 4–5 g dry weight/$m^2$.

14. A packing container in accordance with claim 8, wherein said central layer is of a polyester material.

* * * * *